US008409029B2

(12) United States Patent
Abe

(10) Patent No.: US 8,409,029 B2
(45) Date of Patent: Apr. 2, 2013

(54) GOLF CLUB SET

(75) Inventor: Hiroshi Abe, Kobe (JP)

(73) Assignee: SRI Sports Limited, Hyogo (JP)

( * ) Notice: Subject to any disclaimer, the term of this patent is extended or adjusted under 35 U.S.C. 154(b) by 217 days.

(21) Appl. No.: 12/915,097

(22) Filed: Oct. 29, 2010

(65) Prior Publication Data

US 2011/0105240 A1 May 5, 2011

(30) Foreign Application Priority Data

Oct. 30, 2009 (JP) ..... 2009-249873

(51) Int. Cl.
*A63B 53/04* (2006.01)

(52) U.S. Cl. ..... 473/290; 473/331

(58) Field of Classification Search ..... 473/287, 473/290–291, 330–331
See application file for complete search history.

(56) References Cited

U.S. PATENT DOCUMENTS 4,854,581 A * 8/1989 Long ..... 473/290
5,591,092 A * 1/1997 Gilbert ..... 473/330
5,766,087 A * 6/1998 Kawamatsu ..... 473/290
7,014,568 B2 * 3/2006 Pelz ..... 473/287
7,691,007 B2 * 4/2010 Ban et al. ..... 473/330
7,824,279 B2 * 11/2010 Ban et al. ..... 473/331

FOREIGN PATENT DOCUMENTS

JP 2-228981 9/1990
JP 2001-321469 A 11/2001
JP 3463779 B2 11/2003
JP 2008-5994 A 1/2008

OTHER PUBLICATIONS

JP Office Action dated Jan. 10, 2012 for Application No. 2009-249873.

* cited by examiner

*Primary Examiner* — Stephen L. Blau
(74) *Attorney, Agent, or Firm* — Birch, Stewart, Kolasch & Birch, LLP

(57) ABSTRACT

Groove depths D1 of clubs are defined as D1(1), D1(2), . . . , D1(*n*) in an order from the club having the smallest real loft angle L1, and groove widths W1 of face lines of the clubs measured by the 30 degree method of measurement are defined as W1(1), W1(2), . . . , W1(*n*) in an order from the club having the smallest real loft angle L1. At this time, a golf club set satisfies D1(1)≦D1(2)≦ . . . ≦D1(*n*). A ratio [D1(m)/D1(*m*−1)] of the groove depths D1 between two golf clubs with adjacent club numbers is 1.0 or greater and 3.0 or less. The golf club set satisfies W1(1)≦W1(2)≦ . . . ≦W1(*n*). A ratio [W1(m)/W1(*m*−1)] of the groove widths W1 between two golf clubs with adjacent club numbers is 1.0 or greater and 3.0 or less.

11 Claims, 10 Drawing Sheets

GOLF CLUB SET

This application claims priority on Patent Application No. 2009-249873 filed in JAPAN on Oct. 30, 2009, the entire contents of which are hereby incorporated by reference.

BACKGROUND OF THE INVENTION

1. Field of the Invention

The present invention relates to a golf club set having a plurality of golf clubs.

2. Description of the Related Art

Golf club sets are commercially available. A set of iron type clubs, a set of wood type clubs, a set having utility type clubs andiron type clubs, and a set having wood type clubs and iron type clubs, or the like are known. The golf club set usually includes a plurality of clubs having different real loft angles, lie angles or lengths.

Face lines and face markings are formed on a golf club head. In particular, the face lines are usually formed on the iron type club. The face lines contribute to increase in a backspin rate.

Japanese Patent No. 3463779 discloses an iron golf club set in which a groove area ratio of a long iron group is different from those of a middle iron group and a short iron group.

SUMMARY OF THE INVENTION

The present inventor considered optimization of a face line in a golf club set from a viewpoint different from the conventional technique. As a result, the present inventor attained specification of the face line capable of exhibiting an effect heterogeneous from that of the conventional technique in the golf club set.

It is an object of the present invention to provide a golf club set capable of equalizing a difference between a backspin rate in a dry condition and a backspin rate in a wet condition between two golf clubs with club numbers.

A golf club set of the present invention includes n pieces of golf clubs (n is an integer of equal to or greater than 3). When groove depths D1 of face lines of the clubs are defined as D1(1), D1(2), . . . , D1($n$) in an order from the club having the smallest real loft angle L1; and groove widths W1 of the face lines of the clubs measured by the 30 degree method of measurement are defined as W1(1), W1(2), . . . , W1($n$) in an order from the club having the smallest real loft angle L1, the golf club set satisfies D1(1)≦D1(2)≦ . . . ≦D1($n$) and D1(1)<D1($n$). The groove depths D1 of all the clubs are 0.0 (mm) or greater and 0.508 (mm) or less. A ratio [D1($m$)/D1($m$−1)] of the groove depths D1 between two golf clubs with adjacent club numbers in all the clubs is 1.0 or greater and 3.0 or less. The golf club set satisfies W1(1)≦W1(2)≦ . . . ≦W1($n$). The groove widths W1 of all the clubs are 0.0 (mm) or greater and 0.889 (mm) or less. A ratio [W1($m$)/W1($m$−1)] of the groove widths W1 between two golf clubs with adjacent club numbers in all the clubs is 1.0 or greater and 3.0 or less. Preferably, W1(1)<W1($n$) is further satisfied.

Another golf club set of the present invention includes n pieces of golf clubs (n is an integer of equal to or greater than 3). When groove depths D1 of face lines of the clubs are defined as D1(1), D1(2), . . . , D1($n$) in an order from the club having the smallest real loft angle L1; and groove widths W1 of the face lines of the clubs measured by the 30 degree method of measurement are defined as W1(1), W1(2), . . . , W1($n$) in an order from the club having the smallest real loft angle L1, the golf club set satisfies D1(1)≦D1(2)≦ . . . ≦D1($n$). The groove depths D1 of all the clubs are 0.0 (mm) or greater and 0.508 (mm) or less. A ratio [D1($m$)/D1($m$−1)] of the groove depths D1 between two golf clubs with adjacent club numbers in all the clubs is 1.0 or greater and 3.0 or less. The golf club set satisfies W1(1)≦W1(2)≦ . . . ≦W1($n$) and W1(1)<W1($n$). The groove widths W1 of all the clubs are 0.0 (mm) or greater and 0.889 (mm) or less. A ratio [W1($m$)/W1($m$−1)] of the groove widths W1 between two golf clubs with adjacent club numbers in all the clubs is 1.0 or greater and 3.0 or less. Preferably, D1(1)<D1($n$) is further satisfied.

When groove bottom widths W2 are defined as W2(1), W2(2), . . . , W2($n$) in an order from the club having the smallest real loft angle L1, the golf club set preferably satisfies W2(1)≦W2(2)≦ . . . ≦W2($n$) and W2(1)<W2($n$). Preferably, the groove bottom widths W2 of all the clubs are 0.0 (mm) or greater and 1.0 (mm) or less. Preferably, a ratio [W2($m$)/W2($m$−1)] of the groove bottom widths W2 between two golf clubs with adjacent club numbers in all the clubs is 1.0 or greater and 3.0 or less.

Preferably, a ratio [D1($n$)/D1(1)] is equal to or greater than 1.2. Preferably, a ratio [W1($n$)/W1(1)] is equal to or greater than 1.1.

Preferably, the golf club set includes a golf club having a real loft angle L1 of equal to or less than 40 degrees and a golf club having a real loft angle L1 exceeding 40 degrees.

Preferably, the golf club set includes a golf club having a real loft angle L1 of equal to or greater than 50 degrees.

The difference between the backspin rate in the dry condition and the backspin rate in the wet condition can be equalized between two golf clubs with different club numbers by differentiating the specification of the face line between two golf clubs with club numbers.

DESCRIPTION OF THE PREFERRED EMBODIMENTS

Hereinafter, the present invention will be described below in detail based on preferred embodiments with reference to the drawings.

Figure 1:
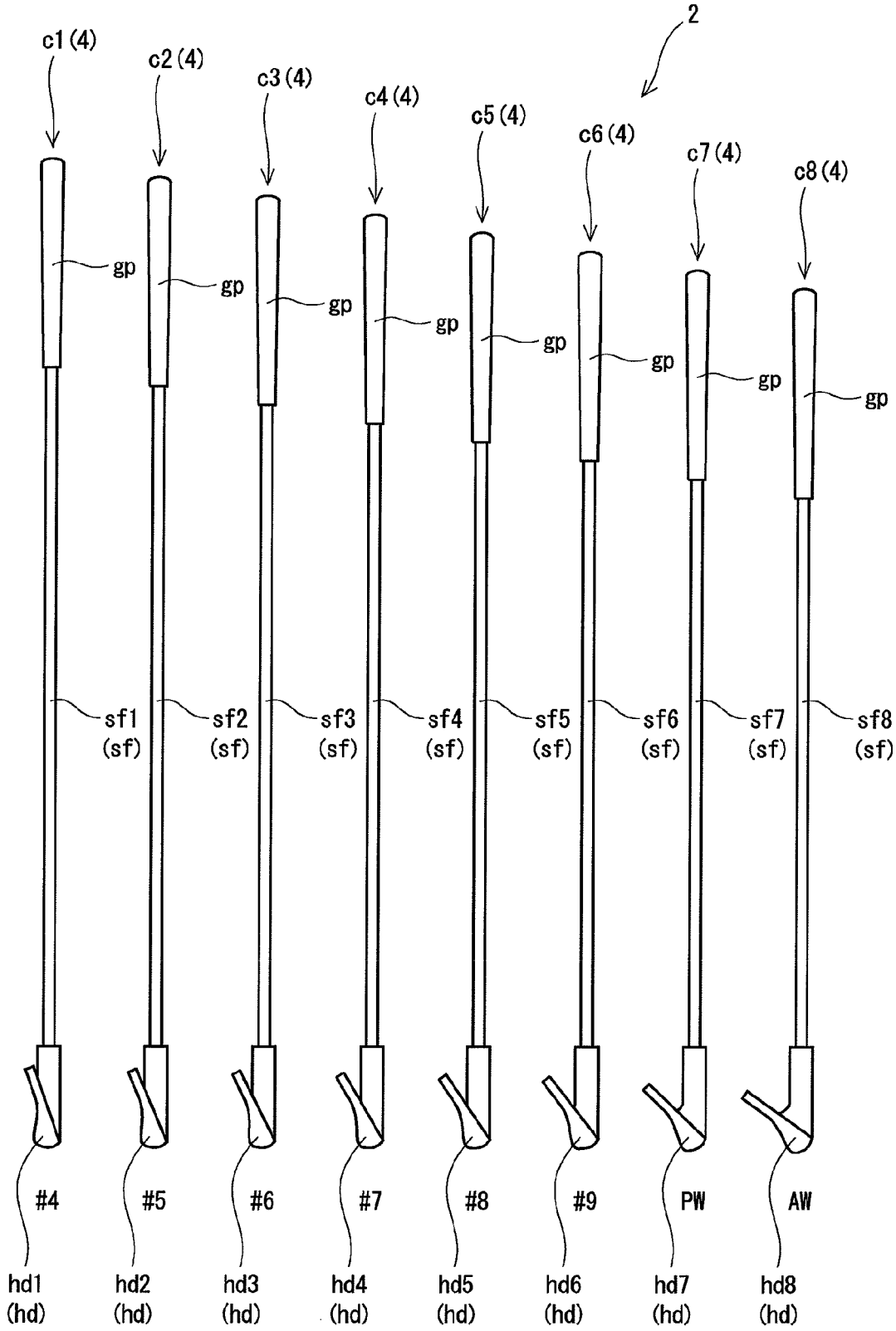
FIG. 1 is a view showing a golf club set according to an embodiment of the present invention.

FIG. 1 is a view showing a golf club set 2 according to an embodiment of the present invention. The golf club set 2 is an iron type golf club set. A real loft angle L1 of the iron type golf club is usually 15 degrees or greater and 70 degrees or less.

The golf club set 2 includes a plurality of golf clubs 4 having different real loft angles L1. The golf club set 2 has eight golf clubs 4. The number of clubs of the golf club set 2 is preferably equal to or greater than 3.

The golf club 4 has a shaft sf, a head hd, and a grip gp. The head hd is mounted to a tip part of the shaft sf. The grip gp is mounted to a butt end part of the shaft sf.

The eight golf clubs 4 are a first golf club c1, a second golf club c2, a third golf club c3, a fourth golf club c4, a fifth golf club c5, a sixth golf club c6, a seventh golf club c7, and an eighth golf club c8 in an order from the club having the smallest real loft angle L1. The golf club with lower club number has a head hd having a smaller real loft angle L1.

The first golf club c1 has a shaft sf1, a head hd1, and a grip gp. The second golf club c2 has a shaft sf2, a head hd2, and a grip gp. The third golf club c3 has a shaft sf3, a head hd3, and a grip gp. The fourth golf club c4 has a shaft sf4, a head hd4, and a grip gp. The fifth golf club c5 has a shaft sf5, a head hd5, and a grip gp. The sixth golf club c6 has a shaft sf6, a head hd6, and a grip gp. The seventh golf club c7 has a shaft sf7, a head hd7, and a grip gp. The eighth golf club c8 has a shaft sf8, a head hd8, and a grip gp.

The golf clubs 4 constituting the golf club set 2 have different club lengths. The golf clubs 4 are the first golf club c1, the second golf club c2, the third golf club c3, the fourth golf club c4, the fifth golf club c5, the sixth golf club c6, the seventh golf club c7, and the eighth golf club c8 in an order of the club length. The golf club with lower club number has a greater club length. The club length is mainly adjusted by the length of the shaft sf. The golf clubs 4 may include golf clubs c having the same length.

Although not shown in FIG. 1, the golf clubs 4 constituting the golf club set 2 have different lie angles. The golf clubs 4 are the first golf club c1, the second golf club c2, the third golf club c3, the fourth golf club c4, the fifth golf club c5, the sixth golf club c6, the seventh golf club c7, and the eighth golf club c8 in an order from the club having the smallest lie angle. The golf club with lower club number has a smaller lie angle. The golf clubs 4 may include the golf clubs c having the same lie angle.

In the embodiment of FIG. 1, the first golf club c1 is a 4-iron; the second golf club c2 is a 5-iron; the third golf club c3 is a 6-iron; the fourth golf club c4 is a 7-iron; the fifth golf club c5 is a 8-iron; the sixth golf club c6 is a 9-iron; the seventh golf club c7 is a pitching wedge; and the eighth golf club c8 is an approach wedge. In the present invention, the club number of the golf club c included in the golf club set 2 is not restricted.

Figure 2:
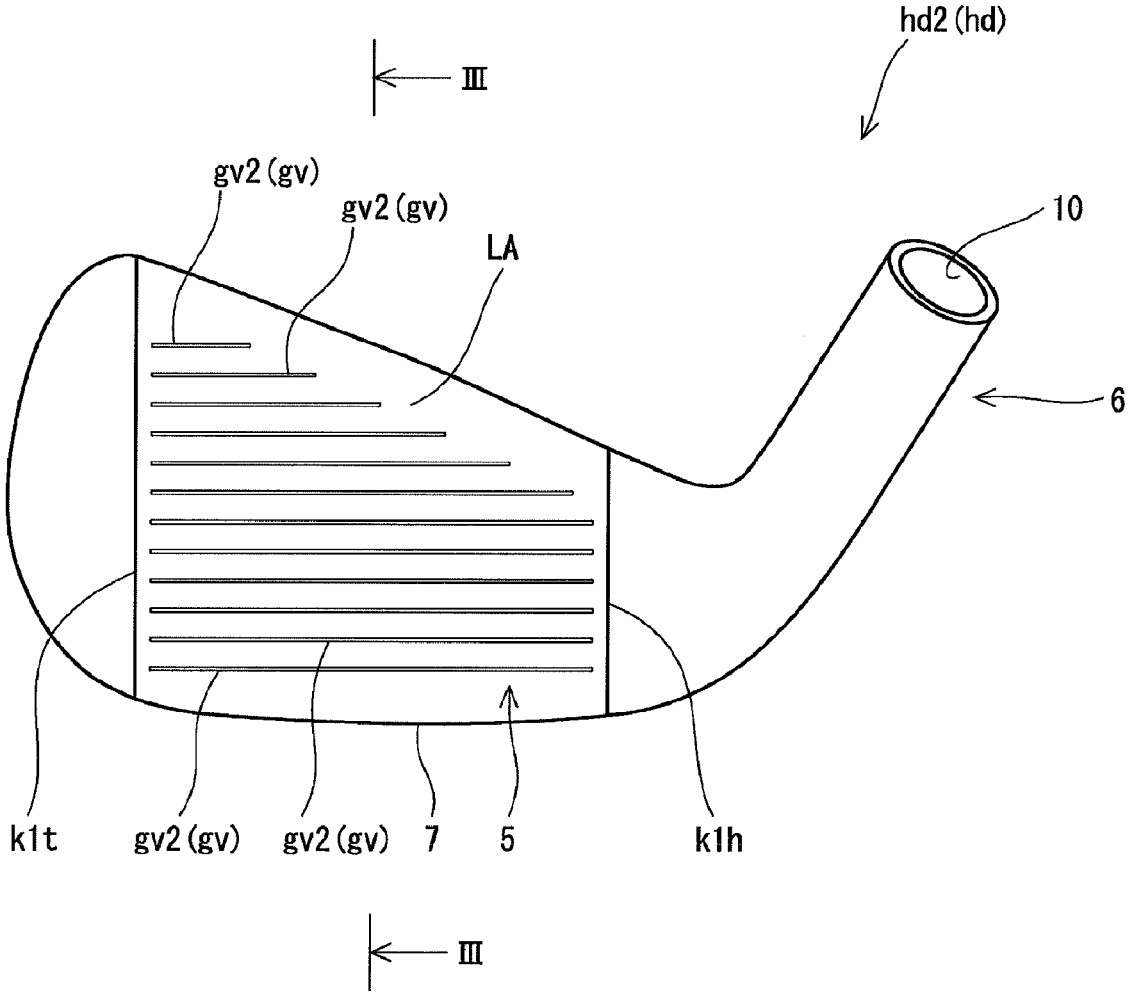
FIG. 2 is a view of a head of a club included in the set of FIG. 1, as viewed from a face side.

FIG. 2 is a view of the head hd2 of the golf club c2 (5-iron), as viewed from a face side. The head hd2 has a face 5, a hosel 6, and a sole 7. The face 5 has face lines gv formed thereon. The golf club head hd has a shaft hole 10 to which a shaft is mounted. The shaft hole 10 is formed in the hosel 6. These structures are the same as those of the heads hd with the other club numbers.

Materials of the head hd and the face 5 are not restricted. The face 5 may be a metal, or may be a nonmetal. Examples of the metal include iron, stainless steel, maraging steel, pure titanium, and a titanium alloy. Examples of the iron include soft iron (a low carbon steel having a carbon content of less than 0.3 wt %). Examples of the nonmetal include CFRP (carbon fiber reinforced plastic).

The head hd2 has a plurality of face lines gv. The face lines gv are grooves. In the present application, the face lines gv are merely also referred to as grooves.

A part of the face 5 is subjected to treatment for adjusting a surface roughness. The typical example of the treatment is shot-blasting treatment. A boundary line k1 between an area which is subjected to the shot-blasting treatment and an area which is not subjected to the shot-blasting treatment is shown in FIG. 2. An area between a toe side boundary line k1*t* and a heel side boundary line k1*h* is subjected to the shot-blasting treatment. All the face lines gv are formed in the area which is subjected to the shot-blasting treatment. A toe side area relative to the toe side boundary line k1*t* is not subjected to the shot-blasting treatment. A heel side area relative to the heel side boundary line k1*h* is not subjected to the shot-blasting treatment. The toe side boundary line k1*t* and the heel side boundary line k1*h* are visually recognized by the absence or presence of the shot-blasting treatment. The surface roughness is increased by the shot-blasting treatment. The increased surface roughness can increase the backspin rate of a ball. The increase in the backspin rate tends to stop the ball near the point of fall. The increase in the backspin rate can facilitate the stopping of the ball at the aiming point. The increase in the backspin rate is particularly useful for a shot targeting a green and an approach shot. As shown in FIG. 2, the boundary layer k1*t* and the boundary layer k1*h* are substantially parallel.

Figure 3:
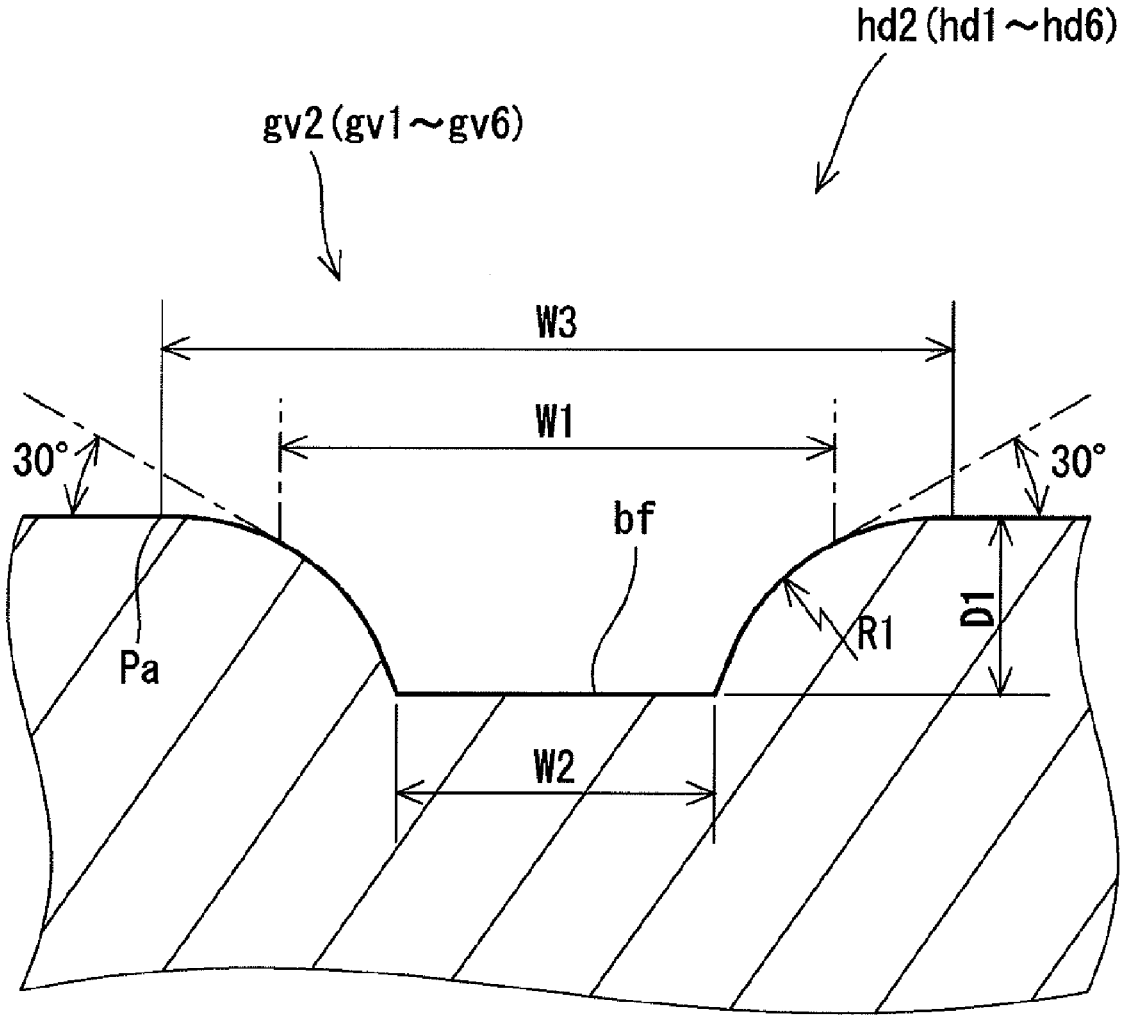
FIG. 3 is a cross sectional view taken along the line III-III of FIG. 2.

FIG. 3 is a cross sectional view taken along the line III-III of FIG. 2. FIG. 3 shows only the vicinity of one face line gv2. The face 5 has a land area LA. The land area LA indicates a portion of a surface of the face (face surface) 5 on which the grooves are not formed. If minute unevenness formed by shot-blasting treatment or the like to be described later is disregarded, the land area LA is substantially a plane. In the present application, the land area LA is considered to be a plane.

A section shape of a face line gv1 of the golf club c1 (4-iron) is the same as that of a face line gv2 (5-iron). A section shape of a face line gv3 of the golf club c3 (6-iron) is the same as that of the face line gv2. A section shape of a face line gv4 of the golf club c4 (7-iron) is the same as that of the face line gv2. A section shape of a face line gv5 of the golf club c5 (8-iron) is the same as that of the face line gv2. A section shape of a face line gv6 of the golf club c6 (9-iron) is the same as that of the face line gv2.

Figure 4:
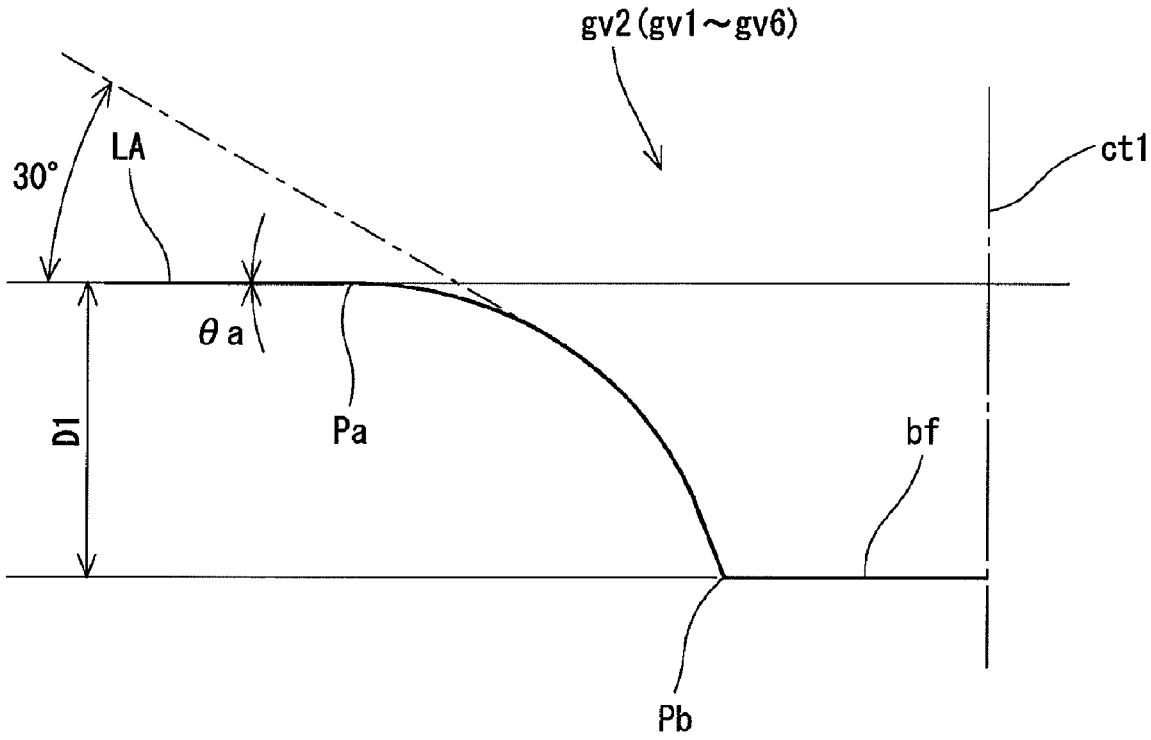
FIG. 4 is a view in which a section line of FIG. 3 is enlarged.

FIG. 4 is an enlarged view in which a section line of a surface of the face line gv2 is described in the cross sectional view of FIG. 3. FIG. 4 shows a section line of a left half of the face line gv2. The section line is axisymmetric about a central line ct1. The detail of the section shape of the face line gv2 will be described later.

Figure 5:
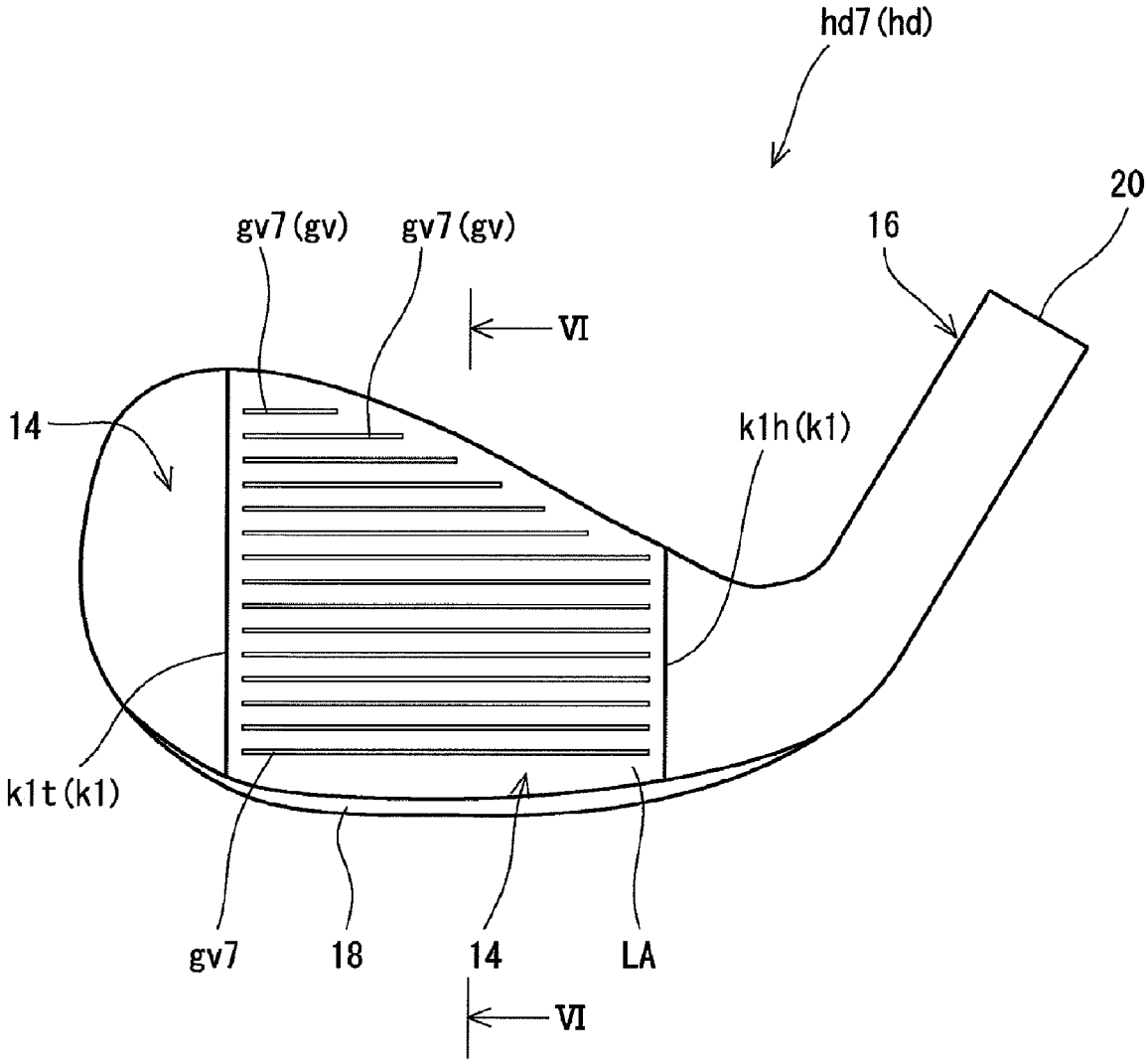
FIG. 5 is a view of a head of another club included in the set of FIG. 1, as viewed from the face side.

FIG. 5 is a view of the head hd7 of the golf club c7 (pitching wedge), as viewed from the face side. The head hd7 has a face 14, a hosel 16, and a sole 18. The face 14 has face lines gv formed thereon. The head hd7 has a shaft hole 20 to which a shaft is mounted. The shaft hole 20 is formed in the hosel 16. These structures are the same as those of the heads hd with the other club numbers.

Figure 6:
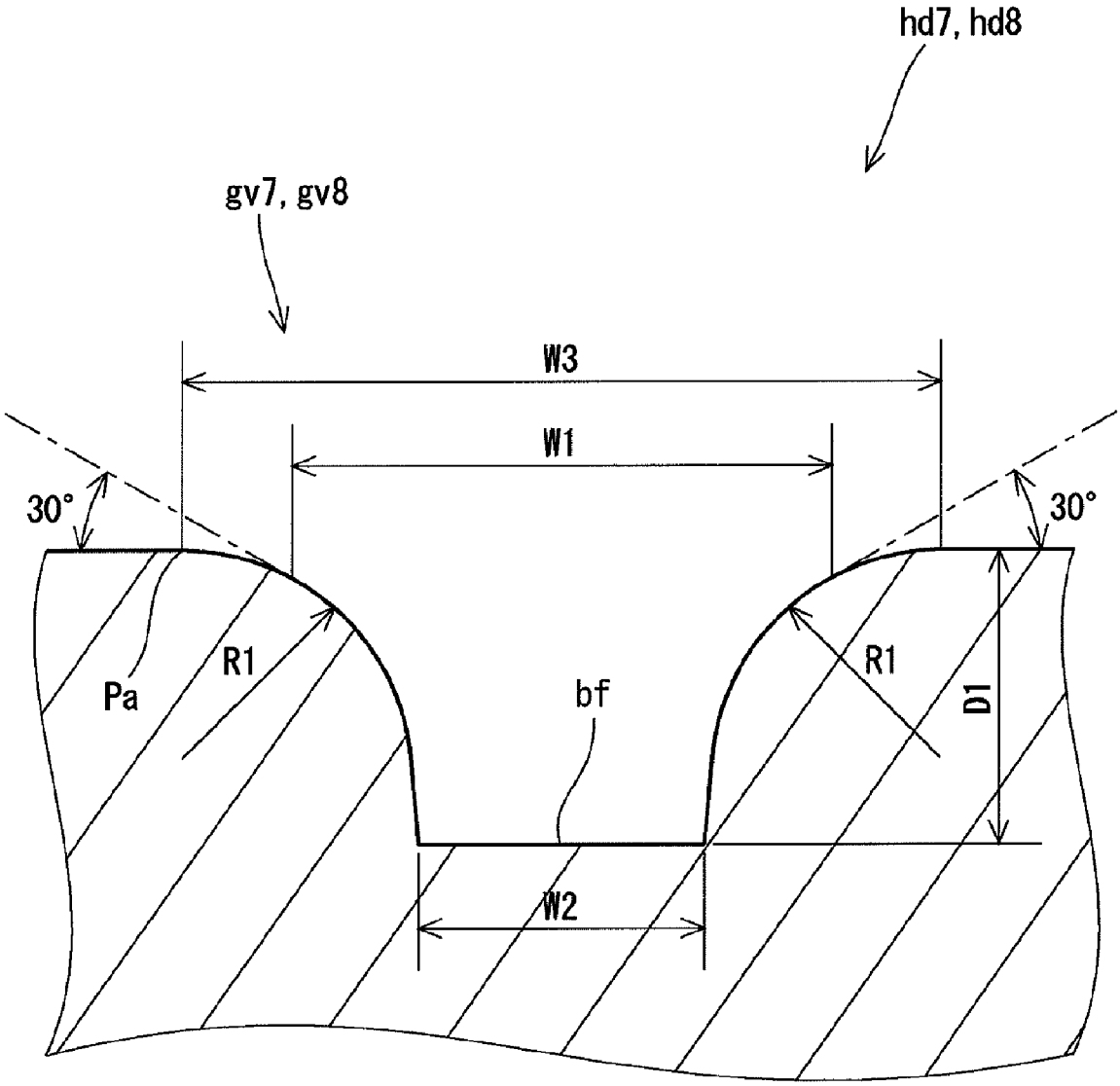
FIG. 6 is a cross sectional view taken along the line VI-VI of FIG. 5.

FIG. 6 is a cross sectional view taken along the line VI-VI of FIG. 5. FIG. 6 shows only the vicinity of one face line gv7. The face 14 has a land area LA.

FIG. 6 is a cross sectional view of the face line gv7 of the golf club c7 (pitching wedge). A section shape of the face line gv8 of the golf club c8 (approach wedge) is the same as that of the face line gv7.

Figure 7:
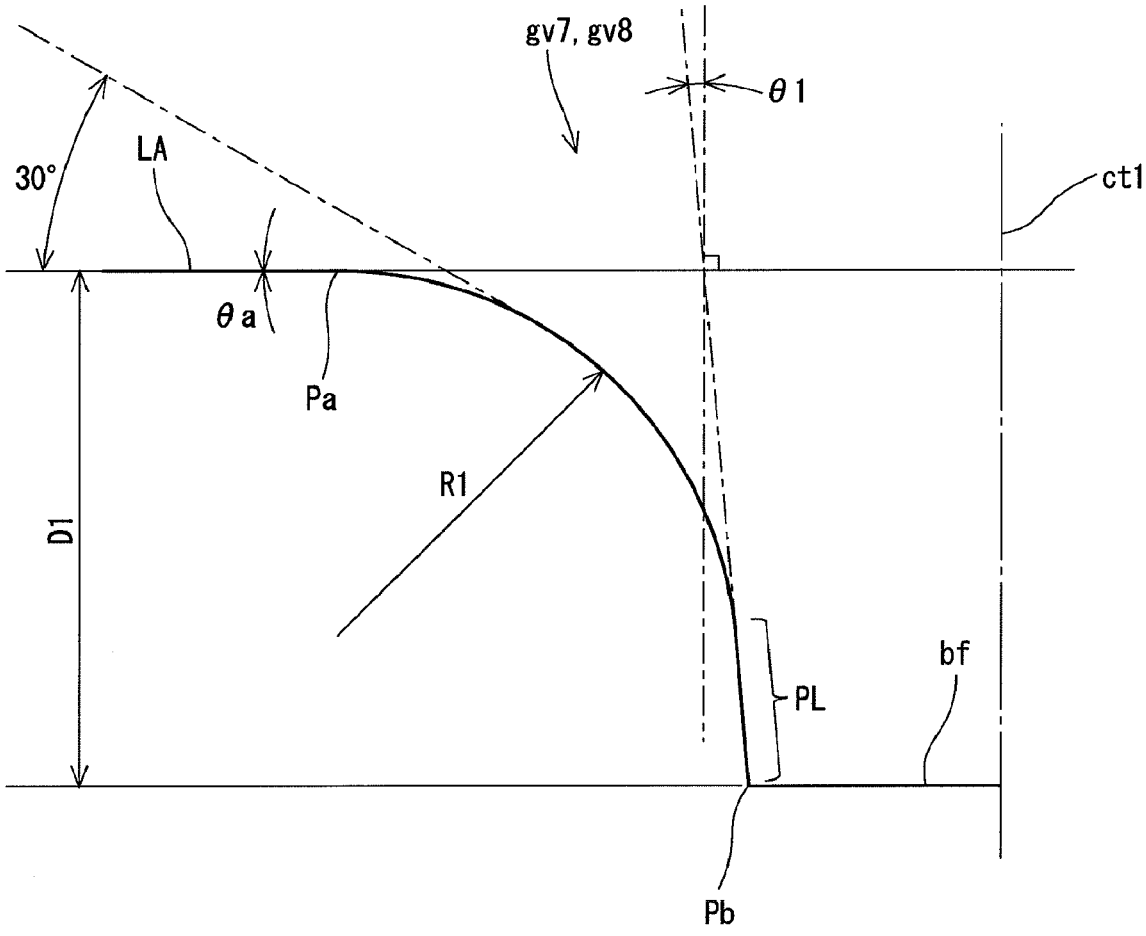
FIG. 7 is a view in which a section line of FIG. 6 is enlarged.

FIG. 7 is an enlarged view in which a section line of a surface of the face line gv7 is described in the cross sectional view of FIG. 6. FIG. 7 shows a section line of a left half of the face line gv. The section line is axisymmetric about a central line ct1. The detail of the section shape of the face line gv7 will be described later.

In the present application, a depth D1 (mm) of the face line is defined (see FIGS. 3 and 6). Hereinafter, the depth D1 is also referred to as a groove depth D1. The groove depth D1 is a distance between the land area LA and a bottom face bf of the face line. The groove depth D1 is measured along a direction perpendicular to the land area LA.

In the section line of the surface of the face line gv, a boundary point between the land area LA and the face line gv is defined as Pa (see FIGS. 3 and 6). In the section line of the surface of the face line gv, an intersection point of the side face and the bottom face bf of the face line gv is defined as Pb (see FIGS. 4 and 7).

A face line width (mm) measured by the 30 degree method of measurement is shown by a double-pointed arrow W1 in FIGS. 3 and 6.

The "30 degree method of measurement" implies a measuring method of a groove distance described in the golf rules defined by R&A (Royal and Ancient Golf Club of Saint Andrews). "Groove volume" in the present application has a meaning described in the golf rules defined by R&A.

A groove bottom width (mm) is shown by a double-pointed arrow W2 in FIGS. 3 and 6. The groove bottom width W2 is a width of the bottom face bf. The bottom face bf is a plane.

An opening width (mm) of the face line is shown by a double-pointed arrow W3 in FIGS. 3 and 6. The opening width W3 is not a groove width measured by the 30 degree method of measurement but an actual groove width. The width W3 is a distance between the points Pa.

The golf club set of the present invention includes n pieces of golf clubs (n is an integer of equal to or greater than 3). In the embodiment, n is 8.

[Groove Depth D1 of Each of Clubs]

The groove depths D1 of the face lines gv of the golf clubs c constituting the golf club set 2 are defined as D1(1), D1(2), . . . , D1(*n*) in an order from the club having the smallest real loft angle L1. In the embodiment, the groove depth D1 of the 4-iron is D1(1); the groove depth D1 of the 5-iron is D1(2); the groove depth D1 of the 6-iron is D1(3); and the groove depth D1 of the 7-iron is D1(4); the groove depth D1 of the 8-iron is D1(5); the groove depth D1 of the 9-iron is D1(6); the groove depth D1 of the pitching wedge is D1(7); and the groove depth D1 of the approach wedge is D1(8).

When the golf club set is constituted by, for example, ten clubs of the 3-iron to the sand wedge unlike the embodiment, the groove depth D1 of the 3-iron is D1(1); the groove depth D1 of the 4-iron is D1(2); the groove depth D1 of the 5-iron is D1(3); the groove depth D1 of the 6-iron is D1(4); the groove depth D1 of the 7-iron is D1(5); the groove depth D1 of the 8-iron is D1(6); the groove depth D1 of the 9-iron is D1(7); the groove depth D1 of the pitching wedge is D1(8); the groove depth D1 of the approach wedge is D1(9); and the groove depth D1 of the sand wedge is D1(10).

[Groove width W1 of Each of Clubs]

The groove widths W1 of the face lines of the clubs c constituting the golf club set 2 are defined as W1(1), W1(2), . . . , W1(*n*) in an order from the club having the smallest real loft angle L1. The groove widths W1 are measured by the 30 degree method of measurement. In the embodiment, the groove width W1 of the 4-iron is W1(1); the groove width W1 of the 5-iron is W1(2); the groove width W1 of the 6-iron is W1(3); the groove width W1 of the 7-iron is W1(4); the groove width W1 of the 8-iron is W1(5); the groove width W1 of the 9-iron is W1(6); the groove width W1 of the pitching wedge is W1(7); and the groove width W1 of the approach wedge is W1(8).

[Groove Bottom Width W2 of Each of Clubs]

The groove bottom widths W2 of the golf clubs c constituting the golf club set 2 are defined as W2(1), W2(2), . . . , W2(*n*) in an order from the club having the smallest real loft angle L1. In the embodiment, the groove bottom width W2 of the 4-iron is W2(1); the groove bottom width W2 of the 5-iron is W2(2); the groove bottom width W2 of the 6-iron is W2(3); the groove bottom width W2 of the 7-iron is W2(4); the groove bottom width W2 of the 8-iron is W2(5); the groove bottom width W2 of the 9-iron is W2(6); the groove bottom width W2 of the pitching wedge is W2(7); and the groove bottom width W2 of the approach wedge is W2(8).

[Real Loft Angle L1 of Each of Clubs]

The real loft angles L1 of the golf clubs c constituting the golf club set 2 are defined as L1(1), L1(2), . . . , L1(*n*) in an order from the club having the smallest real loft angle L1. In the embodiment, the real loft angle L1 of the 4-iron is L1(1); the real loft angle L1 of the 5-iron is L1(2); the real loft angle L1 of the 6-iron is L1(3); the real loft angle L1 of the 7-iron is L1(4); the real loft angle L1 of the 8-iron is L1(5); the real loft angle L1 of the 9-iron is L1(6); the real loft angle L1 of the pitching wedge is L1(7); and the real loft angle L1 of the approach wedge is L1(8).

The golf club set 2 satisfies D1(1)≦D1(2)≦ . . . ≦D1(*n*) and D1(1)<D1(*n*). That is, the golf club set 2 satisfies D1(1)≦D1(2)≦D1(3)≦D1(4)≦D1(5)≦D1(6)≦D1(7)≦D1(8) and D1(1)<D1(8). Specifically, the embodiment satisfies the following expression (1):

$$D1(1)=D1(2)=D1(3)=D1(4)=D1(5)=D1(6)<D1(7)=D1(8) \quad (1)$$

The conformation of the expression (1) is absolutely one example. The positions and number of inequality signs are not restricted. The positions and number of equality signs are not restricted.

In the embodiment, the groove depths D1 of all the clubs are 0.0 (mm) or greater and 0.508 (mm) or less. Preferably, the groove depths D1 of all the clubs exceed 0.0 (mm) and are 0.508 (mm) or less.

In the golf club set 2, a ratio [D1(*m*)/D1(*m*−1)] of the groove depths D1 between two golf clubs with adjacent club numbers is 1.0 or greater and 3.0 or less in all the clubs. That is, [D1(2)/D1(1)] is 1.0 or greater and 3.0 or less; [D1(3)/D1(2)] is 1.0 or greater and 3.0 or less; [D1(4)/D1(3)] is 1.0 or greater and 3.0 or less; [D1(5)/D1(4)] is 1.0 or greater and 3.0 or less; [D1(6)/D1(5)] is 1.0 or greater and 3.0 or less; [D1(7)/D1(6)] is 1.0 or greater and 3.0 or less; and [D1(8)/D1(7)] is 1.0 or greater and 3.0 or less.

The golf club set 2 satisfies W1(1)≦W1(2)≦ . . . ≦W1(*n*) and W1(1)<W1(*n*). That is, the golf club set 2 satisfies W1(1)≦W1(2)≦W1(3)≦W1(4)≦(5)≦W1(6)≦W1(7)≦ W1(8) and W1(1)<W1(8). Specifically, the embodiment satisfies the following expression (2):

$$W1(1)=W1(2)=W1(3)=W1(4)=W1(5)=W1(6)<W1(7)=W1(8) \quad (2)$$

The conformation of the expression (2) is absolutely one example. The positions and number of inequality signs are not restricted. The positions and number of equality signs are not restricted.

In the golf club set 2, the groove widths W1 of all the clubs are 0.0 (mm) or greater and 0.889 (mm) or less. Preferably, the groove widths W1 of all the clubs exceed 0.0 (mm) and are 0.889 (mm) or less.

In the golf club set 2, a ratio [W1(*m*)/W1(*m*−1)] of the groove widths W1 between two golf clubs with adjacent club numbers is 1.0 or greater and 3.0 or less in all the clubs. That is, [W1(2)/W1(1)] is 1.0 or greater and 3.0 or less; [W1(3)/W1(2)] is 1.0 or greater and 3.0 or less; [W1(4)/W1(3)] is 1.0 or greater and 3.0 or less; [W1(5)/W1(4)] is 1.0 or greater and 3.0 or less; [W1(6)/W1(5)] is 1.0 or greater and 3.0 or less; [W1(7)/W1(6)] is 1.0 or greater and 3.0 or less; and [W1(8)/W1(7)] is 1.0 or greater and 3.0 or less.

The golf club set 2 satisfies W2(1)≦W2(2)≦ . . . ≦(n). The golf club set 2 satisfies W2(1)<W2(*n*).

In the golf club set 2, the groove bottom widths W2 of all the clubs are 0.0 (mm) or greater and 1.0 (mm) or less. Preferably, the groove bottom widths W2 of all the clubs exceed 0.0 (mm) and are 1.0 (mm) or less.

In the golf club set 2, a ratio [W2(*m*)/W2(*m*−1)] of the groove bottom widths W2 between two golf clubs with adjacent club numbers is 1.0 or greater and 3.0 or less in all the clubs.

In the golf club set 2, a ratio [D1(*n*)/D1(1)] is equal to or greater than 1.2. In the golf club set 2, a ratio [W1(*n*)/W1(1)] is equal to or greater than 1.1.

The golf club set 2 includes golf clubs c having a real loft angle L1 of equal to or less than 40 degrees and golf clubs c having a real loft angle L1 exceeding 40 degrees. In the golf club set 2, the golf clubs c having the real loft angle L1 of equal to or less than 40 degrees are a 9-iron and clubs (a 4-iron to a 8-iron) having a real loft angle L1 smaller than that of the 9-iron. A 3-iron, a 2-iron, a 1-iron, a driver, a 3-wood, a 4-wood, a 5-wood, a 7-wood, a 9-wood, a 11-wood, a utility type club, and a hybrid type club or the like are exemplified as the other clubs having a real loft angle L1 smaller than 40 degrees. In the golf club set 2, the golf clubs c having the real loft angle L1 exceeding 40 degrees is a pitching wedge and a club (an approach wedge) having a real loft angle L1 larger than that of the pitching wedge. A sand wedge and a lob wedge are exemplified as the other clubs having a real loft angle L1 exceeding 40 degrees.

The golf club set 2 includes a golf club having a real loft angle L1 of equal to or greater than 50 degrees. The golf club c having the real loft angle L1 of equal to or greater than 50 degrees is an approach wedge. A sand wedge and a lob wedge are exemplified as the other clubs having a real loft angle L1 of equal to or greater than 50 degrees.

A dry condition and a wet condition exist in a golf play.

The dry condition is a condition in which no water droplet (liquid water) exists between a ball and a club head at the time of the impact of the ball with the club head. In the fine day, a shot of a ball teed up or a shot from a fairway is usually the dry condition.

The wet condition is a condition in which water droplet (liquid water) exists between a ball and a club head at the time of the impact of the ball with the club head. The wet condition may arise in rainy weather, immediately after the rainy weather, or in the case where morning dew is attached to a lawn, or the like. Since grass exists between a ball and a head in a shot from a rough, the shot is close to a shot in the wet condition. A so-called "flier" may arise in the shot from the rough. A backspin rate of the flier is smaller than that of the usual shot. The flier may cause unintended increase in a distance, an unintended track, and unintended rolling on a green, or the like.

When a difference between the backspin rate in the dry condition and the backspin rate in the wet condition is great, the difference is apt to cause a missed hit. Golfers usually imagine the dry condition and select clubs. When the backspin rate is greatly reduced depending on the wet condition, the missed hit is apt to be caused by the unintended distance or the like. A golf club having a small difference between the backspin rate in the dry condition and the backspin rate in the wet condition is preferable.

Hereinafter, the difference between the backspin rate in the dry condition and the backspin rate in the wet condition is also referred to as a "D−W difference". The present inventor found that the D−W difference is different depending on a club number. The difference will be shown in examples to be described later. It is difficult for players to predict the difference when the D−W difference is different depending on the club number. Thereby, the probability of the missed hit is further increased.

The present invention can equalize the D−W difference between two golf clubs with club numbers. The effect will be shown in examples to be described later.

In the comparison of the dry condition with the wet condition, the backspin rate in the wet condition was considered to be smaller than that in the dry condition. However, in fact, it was found that the backspin rate in the wet condition may be more than that in the dry condition.

It was found that the backspin rate in the wet condition is greater than that in the dry condition in the golf club c having a comparatively small real loft angle L1. On the other hand, it was found that the backspin rate in the dry condition is conversely greater than that in the wet condition in the golf club c having a comparatively greater real loft angle L1. It was found that the inversion phenomenon occurs when the real loft angle L1 is about 40 degrees or greater and about 45 degrees or less.

It was found that the D−W difference tends to be increased so the real loft angle L1 is increased when the real loft angle L1 exceeds 40 degrees. It was found that the tendency is apt to be further actualized when the real loft angle L1 is equal to or greater than 50 degrees.

Although the details of these phenomena are unknown, it can be estimated that the recoil (re-twist) of a golf ball become involved in the phenomena. The recoil is known to reduce the backspin rate.

Since amount of a compressive deformation of a golf club with a club number having a small real loft angle L1 in hitting the ball is great, the influence of the recoil is believed to be great. Slip arises slightly between the ball and the club depending on the wet condition. The slip is believed to suppress the degree of the recoil. The backspin rate is believed to be increased in the wet condition by suppressing the recoil.

On the other hand, since amount of a compressive deformation with a golf club of a club number having a great real loft angle L1 in hitting the ball is small, the influence of the recoil is believed to be small. In addition, slip between the ball and the club with the club number having the great real loft angle L1 is great depending on the wet condition. The slip is believed to decrease the backspin rate caused by a friction force between the club and the ball.

While the slip caused by the wet condition reduces the friction force between the club and the ball, the slip can suppress the recoil. Since the club with the club number having the small real loft angle L1 has a strong effect for suppressing the recoil, the backspin rate in the wet condition is believed to exceed the backspin rate in the dry condition. On the other hand, since an influence for reducing the friction force between the club with the club number having the large real loft angle L1 and the ball is greater than that for suppressing the recoil, the backspin rate in the dry condition is believed to exceed the backspin rate in the wet condition.

It was found that the difference between the dry condition and the wet condition is apt to be enlarged when the real loft angle L1 is equal to or greater than 40 degrees, further equal to or greater than 43 degrees, further equal to or greater than 45 degrees, and further equal to or greater than 50 degrees. It was found that the D−W difference in the golf club c having the large real loft angle L1 is greater than the D−W difference in the golf club c having the small real loft angle L1 in the usual face line.

The D−W difference in the golf club set 2 can be equalized by the specification of the face line gv described above. The D−W difference in the golf club c having the small real loft angle L1 and the D−W difference in the golf club c having the large real loft angle L1 can be equalized by the specification of the face line gv described above. The equalization can reduce variation in the D−W difference for every club number to suppress the missed hit.

The effect of the present invention is apt to be actualized so the difference of the real loft angle L1 is greater. In this respect, the number n of the clubs is preferably equal to or greater than 4, more preferably equal to or greater than 5, still more preferably equal to or greater than 6, yet still more preferably equal to or greater than 7, and particularly preferably equal to or greater than 8. In the golf rules, the number of the clubs capable of being used during a play is restricted. In this respect, the number n of the clubs is preferably equal to or less than 12, more preferably equal to or less than 11, and still more preferably equal to or less than 10. The difference [L1($m$)−L1($m$−1)] of the real loft angles L1 between two golf clubs with adjacent club numbers is usually 2 degrees or greater and 6 degrees or less.

The variation in the D−W difference is suppressed by satisfying D1(1)≦D1(2)≦ . . . ≦D1($n$) and D1(1)<D1($n$). Considering relevance between the real loft angle L1 and the backspin rate, when the groove depth D1 of the club having the greatest real loft angle L1, among the clubs having the real loft angle L1 of equal to or less than 40 degrees is defined as D1(X), and the groove depth D1 of the club having the smallest real loft angle L1, among the clubs having the real loft angle L1 of equal to or greater than 50 degrees is defined as D1(Y), D1(X)<D1(Y) is preferably satisfied.

In respect of suppressing the variation in the D−W difference in the set, the ratio [D1($m$)/D1($m$−1)] of the groove depths D1 between two golf clubs with adjacent club numbers in all the clubs is preferably equal to or greater than 1.0. In respect of suppressing the difference in the D−W difference between two golf clubs with adjacent club numbers, the ratio [D1($m$)/D1($m$−1)] of the groove depths D1 between two golf clubs with adjacent club numbers in all the clubs is preferably equal to or less than 3.0, more preferably equal to or less than 2.0, and still more preferably equal to or less than 1.6.

In respect of suppressing the variation in the D−W difference in the set, W1(1)≦W1(2)≦ . . . ≦W1($n$) and W1(1)<W1($n$) are preferably satisfied. Considering the relevance between the real loft angle L1 and the backspin rate, when the groove width W1 of the club having the greatest real loft angle L1, among the clubs having the real loft angle L1 of equal to or less than 40 degrees is defined as W1(X), and the groove depth W1 of the club having the smallest real loft angle L1, among the clubs having the real loft angle L1 of equal to or greater than 50 degrees is defined as W1(Y), W1(X)<W1(Y) is preferably satisfied.

In respect of suppressing the variation in the D−W difference in the set, the ratio [W1($m$)/W1($m$−1)] of the groove widths W1 between two golf clubs with adjacent club numbers in all the clubs is preferably equal to or greater than 1.0. In respect of suppressing the difference in the D−W difference between two golf clubs with adjacent club numbers, the ratio [W1($m$)/W1($m$−1)] of the groove widths W1 between two golf clubs with adjacent club numbers in all the clubs is preferably equal to or less than 3.0, more preferably equal to or less than 2.0, and still more preferably equal to or less than 1.5.

In respect of suppressing the variation in the D−W difference in the set, W2(1)≦W2(2)≦ . . . ≦W2($n$) and W2(1)<W2($n$) are preferably satisfied.

In respect of suppressing the variation in the D−W difference in the set, the ratio [W2($m$)/W2($m$−1)] of the groove bottom widths W2 between two golf clubs with adjacent club numbers in all the clubs is preferably equal to or greater than 1.0. In respect of suppressing the difference in the D−W difference between two golf clubs with adjacent club numbers, the ratio [W2($m$)/W2($m$−1)] of the groove bottom widths W2 between two golf clubs with adjacent club numbers in all the clubs is preferably equal to or less than 3.0, more preferably equal to or less than 2.0, and still more preferably equal to or less than 1.5.

In respect of suppressing the variation in the D−W difference in the set, the ratio [D1($n$)/D1(1)] is preferably equal to or greater than 1.2, more preferably equal to or greater than 1.3, and still more preferably equal to or greater than 1.5. In respect of the conformity to the rules, the ratio [D1($n$)/D1(1)] is preferably equal to or less than 4.0.

In respect of suppressing the variation in the D−W difference in the set, the ratio [W1($n$)/W1(1)] is preferably equal to or greater than 1.1, more preferably equal to or greater than 1.2, still more preferably equal to or greater than 1.3, and yet still more preferably equal to or greater than 1.5. In respect of the conformity to the rules, the ratio [W1($n$)/W1(1)] is preferably equal to or less than 5.5 and more preferably equal to or less than 4.0.

When the relevance between the real loft angle L1 and the backspin rate is considered, it is preferable that the golf club set includes a golf club having a real loft angle L1 of equal to or less than 40 degrees and a golf club having a real loft angle L1 exceeding 40 degrees. The constitution can reduce deviation between the D−W difference of the golf club having the real loft angle L1 of equal to or less than 40 degrees and the D−W difference of the golf club having the real loft angle L1 exceeding 40 degrees.

When the relevance between the real loft angle L1 and the backspin rate is considered, it is preferable that the golf club set includes a golf club having a real loft angle L1 of equal to or greater than 50 degrees. The constitution can suppress the D−W difference in the golf club having the real loft angle L1 of equal to or greater than 50 degrees.

Curvature radius R1 of edges of the face lines are defined as R1(1), R1(2), . . . , R1($n$) in an order from the club having the smallest real loft angle L1. The curvature radius R1 may be constant in all the clubs. Even when the curvature radius R1 is constant, the suppression of the variation in the D−W difference in the set can be achieved by the regulation of the groove depth D1 or the groove width W1. R1(1)≧R1(2)≧ . . . ≧R1($n$) and R1(1)>R1($n$) may be satisfied. The regulation has the same main purport as that of the regulation of the groove depth D1 and the groove width W1. That is, it is the main purport to reduce the curvature radius R1 to suppress the enlargement of the D−W difference when the real loft angle L1 is great.

The curvature radius R1 may be constant and may be changed. In respect of easiness of groove processing, the curvature radius R1 is preferably constant.

In respect of the conformity to the rules, the curvature radius R1 is preferably equal to or greater than 0.10 (mm), more preferably equal to or greater than 0.20 (mm), and still more preferably equal to or greater than 0.25 (mm). In respect of spin performance caused by the edge, the curvature radius R1 is preferably equal to or less than 0.50 (mm), more preferably equal to or less than 0.40 (mm), and still more preferably equal to or less than 0.30 (mm). The range of the curvature radius R1 is preferably satisfied in all the clubs.

In respect of the spin performance, the width W1 is preferably equal to or greater than 0.4 (mm) and more preferably equal to or greater than 0.5 (mm). In respect of the conformity to the rules, the width W1 is preferably equal to or less than 0.889 (mm) and more preferably equal to or less than 0.8 (mm). The numerical range of the groove width W1 is preferably satisfied in all the clubs.

In respect of the spin performance caused by the Groove volume, the width W2 is preferably equal to or greater than 0.2 (mm) and more preferably equal to or greater than 0.5 (mm). In respect of the conformity to the rules, the width W2 is preferably equal to or less than 0.7 (mm) and more preferably equal to or less than 0.6 (mm). The numerical range of the width W2 is preferably satisfied in all the clubs.

In respect of the spin performance caused by the Groove volume, the width W3 is preferably equal to or greater than 0.4 (mm) and more preferably equal to or greater than 0.5 (mm). In respect of the conformity to the rules, the width W3 is preferably equal to or less than 1.20 (mm) and more preferably equal to or less than 1.0 (mm). The numerical range of the width W3 is preferably satisfied in all the clubs.

In respect of the conformity to the rules, a ratio (W1/W2) is preferably equal to or greater than 1.4, more preferably equal to or greater than 1.6, and still more preferably equal to or greater than 1.7. In respect of the spin performance caused by the edge, the ratio (W1/W2) is preferably equal to or less than 3.0, more preferably equal to or less than 2.7, and still more preferably equal to or less than 2.5. The numerical range of the ratio (W1/W2) is preferably satisfied in all the clubs.

In respects of durability of a cutter and of suppression of damage of a ball, or the like, it is preferable that a side of a face line (from a point Pa to a point Pb) smoothly continues in all the clubs.

In respect of the conformity to the rules, the groove depth D1 (mm) is preferably equal to or less than 0.508 (mm), more preferably equal to or less than 0.480 (mm), and still more preferably equal to or less than 0.460 (mm). In respect of the spin performance caused by the Groove volume, the groove depth D1 is preferably equal to or greater than 0.100 (mm), more preferably equal to or greater than 0.200 (mm), and still more preferably equal to or greater than 0.250 (mm). The numerical range of the groove depth D1 is preferably satisfied in all the clubs.

An angle θa between a tangent line at the point Pa and the land area LA is not restricted. In respect of suppressing the damage of the ball, it is preferable that the point Pa and the land area LA are almost smooth. In this respect, the angle θa is preferably equal to or less than 20 degrees, more preferably equal to or less than 10 degrees, still more preferably equal to or less than 5 degrees, and most preferably 0 degree. A point Px (not shown) on the section line located between the point Pa and the point Pb is considered and a straight line Lax (not shown) connecting the point Px and the point Pa is further considered. In this case, the tangent line at the point Pa implies a line to which the straight line Lax comes close without limit in the case where the point Px comes close to the point Pa without limit along the section line. In the embodiments of FIGS. 4 and 7, the angle θa is 0 degree. The numerical range of the angle θa is preferably satisfied in all the clubs.

A groove distance S1 (a width of the land area LA between two adjacent grooves) is preferably set in consideration of the conformity to the golf rules. In respect of the conformity to the rules, the groove distance S1 is preferably equal to or greater than three times the groove width W1.

A formation method of the face line gv is not restricted. As the formation method of the face line gv, forging, press processing, casting and cutting processing (carving) are exemplified.

In the cutting processing, the cutting processing of the face line is carried out using the cutter. On the other hand, in the press processing, a face line metal mold which has a protruded part corresponding to the shape of the face line gv is used. The face line metal mold is forced on the face to form the face line gv. The face line metal mold in the press processing may be referred to as a "face line engraved mark" by a person skilled in the art.

In the case of the forging, the metal mold is comparatively inexpensive, and maintenances such as correction are also easy. On the other hand, in the case of the forging, a receiving jig for supporting the back side of the head is required. The receiving jig requires high accuracy. The heat treatment in the forging is apt to generate organization change. The organization change may cause strength reduction.

In the case of the forging, the face line metal mold is inexpensive, and maintenances such as correction are also easy. On the other hand, in the case of the press processing, a receiving jig for supporting the back side of the head is required. The receiving jig requires high accuracy.

Since the face line is also formed in the casting while the head is cast, there is less time and effort for forming the face line gv. However, the molten metal stream during the casting may cause the occurrence of a defect in the face line gv.

In respect of the dimensional accuracy of the section shape of the face line gv, the cutting processing is most preferable.

In the cutting processing, the edge of the face line gv is apt to be excessively sharp. The edge is apt to damage the ball. In this respect, processing for rounding the edge may be carried out after the cutting processing. Buff and shot blasting are exemplified as the processing for rounding the edge. The buff is carried out, for example, by a wire brush. When the processing for rounding the edge after the cutting processing is carried out, the variation in the section shape of the face line gv is apt to occur. In this respect, the edge is preferably rounded by the cutting processing. That is, the curvature radius R1 is preferably applied by the cutter.

In respects of productivity and of dimensional accuracy, the face lines gv are preferably formed by one time cutting using the cutter.

As shown in FIGS. 3 and 6, a roundness of the curvature radius R1 is preferably applied to the edge of the face line gv.

EXAMPLES

Hereinafter, the effects of the present invention will be clarified by examples. However, the present invention should not be interpreted in a limited way based on the description of the examples.

Example 1

Heads for a 3-iron to a sand wedge of "XXIO5 Iron" (trade name) were used as heads having no face line formed thereon. The face lines were formed on these heads. An NC processing machine having a cutter was used for processing the face lines. The face lines were formed by cutting processing using the cutter. The material of the cutter was tungsten carbide. The section shape of the cutter was made the same as that of the face line. Therefore, the face lines were formed by one time cutting.

The number and disposal of the face lines were made the same as those of "XXIO5 iron".

The face surface on which the face lines were formed was subjected to shot finishing. The shot finishing does not change the section shape of the face line substantially.

A shaft and a grip were mounted to the obtained head to obtain a golf club. "NS950 R" (trade name) manufactured by Nippon Shaft Co., Ltd. was used as the shaft. A club length and a swing balance (14 inch method) were made the same as those of "XXIO5 iron".

Examples 2, 3 and Comparative Examples 1, 2

Heads having face lines having different section shapes were obtained by changing the shape of the cutter. Heads and clubs of examples 2, 3 and comparative examples 1, 2 were obtained in the same manner as in the example 1 except for specifications shown in the following Tables.

When a plane part PL exists on the side of the face line gv as in the embodiment of FIG. 7, a groove angle θ1 is defined (see FIG. 7). When the plane part PL does not exist on the side of the face line gv, the angle θ1 does not exist. All the sides of the face lines gv were set to curved surfaces in the heads in which the angle θ1 is not described in the following Tables.

The specifications of the example 1 are shown in the following Table 1. The specifications of the example 2 are shown in the following Table 2. The specifications of example 3 are shown in the following Table 3. The specifications of comparative example 1 are shown in the following Table 4. The specifications of comparative example 2 are shown in the following Table 5.

TABLE 1

Specifications of example 1

| | Unit | #3 | #4 | #5 | #6 | #7 | #8 | #9 | PW | AW | SW |
|---|---|---|---|---|---|---|---|---|---|---|---|
| Real loft angle L1 | degree | 20 | 22 | 24 | 27 | 30 | 34 | 39 | 44 | 50 | 56 |
| Curvature radius R1 | mm | 0.30 | 0.30 | 0.30 | 0.30 | 0.30 | 0.30 | 0.30 | 0.30 | 0.30 | 0.30 |
| Groove angle θ1 | degree | — | — | — | — | — | — | — | 5.0 | 5.0 | 5.0 |
| Groove depth D1 | mm | 0.25 | 0.25 | 0.25 | 0.25 | 0.25 | 0.25 | 0.25 | 0.40 | 0.40 | 0.40 |
| Groove width W1 | mm | 0.70 | 0.70 | 0.70 | 0.70 | 0.70 | 0.70 | 0.70 | 0.70 | 0.70 | 0.70 |
| Groove bottom width W2 | mm | 0.50 | 0.50 | 0.50 | 0.50 | 0.50 | 0.50 | 0.50 | 0.50 | 0.50 | 0.50 |
| Groove pitch | mm | 3.60 | 3.60 | 3.60 | 3.60 | 3.60 | 3.60 | 3.60 | 3.60 | 3.60 | 3.60 |

TABLE 2

Specifications of example 2

| | Unit | #3 | #4 | #5 | #6 | #7 | #8 | #9 | PW | AW | SW |
|---|---|---|---|---|---|---|---|---|---|---|---|
| Real loft angle L1 | degree | 20 | 22 | 24 | 27 | 30 | 34 | 39 | 44 | 50 | 56 |
| Curvature radius R1 | mm | 0.30 | 0.30 | 0.30 | 0.30 | 0.30 | 0.30 | 0.30 | 0.30 | 0.30 | 0.30 |
| Groove angle θ1 | degree | — | — | — | — | — | — | — | — | — | — |
| Groove depth D1 | mm | 0.25 | 0.25 | 0.25 | 0.25 | 0.25 | 0.25 | 0.25 | 0.40 | 0.40 | 0.40 |
| Groove width W1 | mm | 0.70 | 0.70 | 0.70 | 0.70 | 0.70 | 0.70 | 0.80 | 0.80 | 0.80 | 0.80 |
| Groove bottom width W2 | mm | 0.38 | 0.38 | 0.38 | 0.38 | 0.38 | 0.38 | 0.48 | 0.48 | 0.48 | 0.48 |
| Groove pitch | mm | 3.60 | 3.60 | 3.60 | 3.60 | 3.60 | 3.60 | 3.60 | 3.60 | 3.60 | 3.60 |

TABLE 3

Specifications of example 3

| | Unit | #3 | #4 | #5 | #6 | #7 | #8 | #9 | PW | AW | SW |
|---|---|---|---|---|---|---|---|---|---|---|---|
| Real loft angle L1 | degree | 20 | 22 | 24 | 27 | 30 | 34 | 39 | 44 | 50 | 56 |
| Curvature radius R1 | mm | 0.30 | 0.30 | 0.30 | 0.30 | 0.30 | 0.30 | 0.30 | 0.30 | 0.30 | 0.30 |
| Groove angle θ1 | degree | — | — | — | — | — | 5.0 | 5.0 | 5.0 | 5.0 | 5.0 |
| Groove depth D1 | mm | 0.10 | 0.15 | 0.20 | 0.25 | 0.30 | 0.35 | 0.40 | 0.45 | 0.50 | 0.55 |
| Groove width W1 | mm | 0.50 | 0.55 | 0.60 | 0.65 | 0.70 | 0.75 | 0.80 | 0.80 | 0.80 | 0.80 |
| Groove bottom width W2 | mm | 0.25 | 0.34 | 0.37 | 0.36 | 0.41 | 0.44 | 0.49 | 0.48 | 0.47 | 0.46 |
| Groove pitch | mm | 3.60 | 3.60 | 3.60 | 3.60 | 3.60 | 3.60 | 3.60 | 3.60 | 3.60 | 3.60 |

TABLE 4

Specifications of comparative example 1

| | Unit | #3 | #4 | #5 | #6 | #7 | #8 | #9 | PW | AW | SW |
|---|---|---|---|---|---|---|---|---|---|---|---|
| Real loft angle L1 | degree | 20 | 22 | 24 | 27 | 30 | 34 | 39 | 44 | 50 | 56 |
| Curvature radius R1 | mm | 0.30 | 0.30 | 0.30 | 0.30 | 0.30 | 0.30 | 0.30 | 0.30 | 0.30 | 0.30 |
| Groove angle θ1 | degree | — | — | — | — | — | — | — | — | — | — |

TABLE 4-continued

| Specifications of comparative example 1 | | | | | | | | | | | |
|---|---|---|---|---|---|---|---|---|---|---|---|
| | Unit | #3 | #4 | #5 | #6 | #7 | #8 | #9 | PW | AW | SW |
| Groove depth D1 | mm | 0.25 | 0.25 | 0.25 | 0.25 | 0.25 | 0.25 | 0.25 | 0.25 | 0.25 | 0.25 |
| Groove width W1 | mm | 0.70 | 0.70 | 0.70 | 0.70 | 0.70 | 0.70 | 0.70 | 0.70 | 0.70 | 0.70 |
| Groove bottom width W2 | mm | 0.50 | 0.50 | 0.50 | 0.50 | 0.50 | 0.50 | 0.50 | 0.50 | 0.50 | 0.50 |
| Groove pitch | mm | 3.60 | 3.60 | 3.60 | 3.60 | 3.60 | 3.60 | 3.60 | 3.60 | 3.60 | 3.60 |

TABLE 5

| Specifications of comparative example 2 | | | | | | | | | | | |
|---|---|---|---|---|---|---|---|---|---|---|---|
| | Unit | #3 | #4 | #5 | #6 | #7 | #8 | #9 | PW | AW | SW |
| Real loft angle L1 | degree | 20 | 22 | 24 | 27 | 30 | 34 | 39 | 44 | 50 | 56 |
| Curvature radius R1 | mm | 0.30 | 0.30 | 0.30 | 0.30 | 0.30 | 0.30 | 0.30 | 0.30 | 0.30 | 0.30 |
| Groove angle θ1 | degree | 5.0 | 5.0 | 5.0 | 5.0 | — | — | — | — | — | — |
| Groove depth D1 | mm | 0.50 | 0.45 | 0.40 | 0.35 | 0.30 | 0.25 | 0.20 | 0.20 | 0.20 | 0.20 |
| Groove width W1 | mm | 0.90 | 0.85 | 0.80 | 0.75 | 0.70 | 0.65 | 0.60 | 0.55 | 0.55 | 0.55 |
| Groove bottom width W2 | mm | 0.58 | 0.53 | 0.48 | 0.43 | 0.40 | 0.36 | 0.32 | 0.27 | 0.27 | 0.27 |
| Groove pitch | mm | 3.60 | 3.60 | 3.60 | 3.60 | 3.60 | 3.60 | 3.60 | 3.60 | 3.60 | 3.60 |

[Evaluation of Backspin Rate]

The clubs were mounted to a swing robot. Balls were hit on a sweet spot SS to measure backspin rates. Head speeds were set as follows. These head speeds were obtained by assuming a head speed with high frequency in use of each of the clubs.

3-iron (#3): 41 m/s
4-iron (#4): 40 m/s
5-iron (#5): 38.5 m/s
6-iron (#6): 37 m/s
7-iron (#7): 36 m/s
8-iron (#8): 35 m/s
9-iron (#9): 33.5 m/s
Pitching Wedge (PW): 30 m/s
Approach Wedge (AW): 25 m/s
Sand Wedge (SW): 21 m/s A ball provided with a cover mainly including a urethane-based compound was used for evaluating the backspin rate. Specifically, "SRIXON Z-STAR" (trade name) manufactured by SRI Sports Limited was used.

The backspin rate in the wet condition and the backspin rate in the dry condition were measured. In the measurement of the wet condition, after the entire ball was dipped in water, the ball was then set on a tee of the swing robot and the ball was hit. In the measurement of the dry condition, a ball having a surface of a drying state was hit.

The average value of ten measurements was used as an evaluation value. The measurement results of the backspin rates are shown in graphs.

Figure 8:
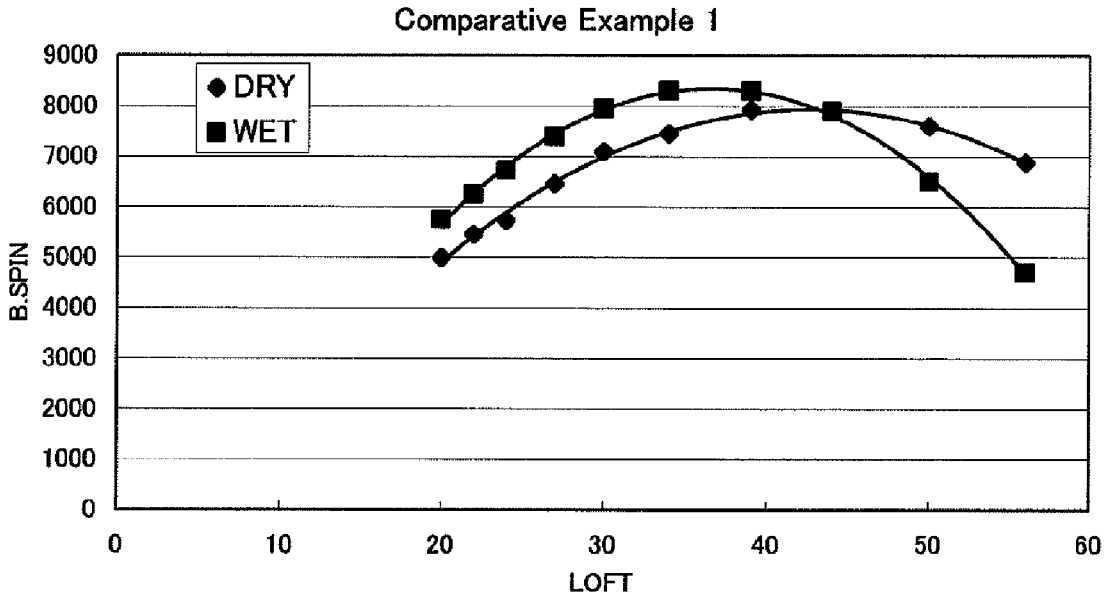
FIG. 8 is a graph showing measurement results of backspin rates of comparative example 1.
Figure 9:
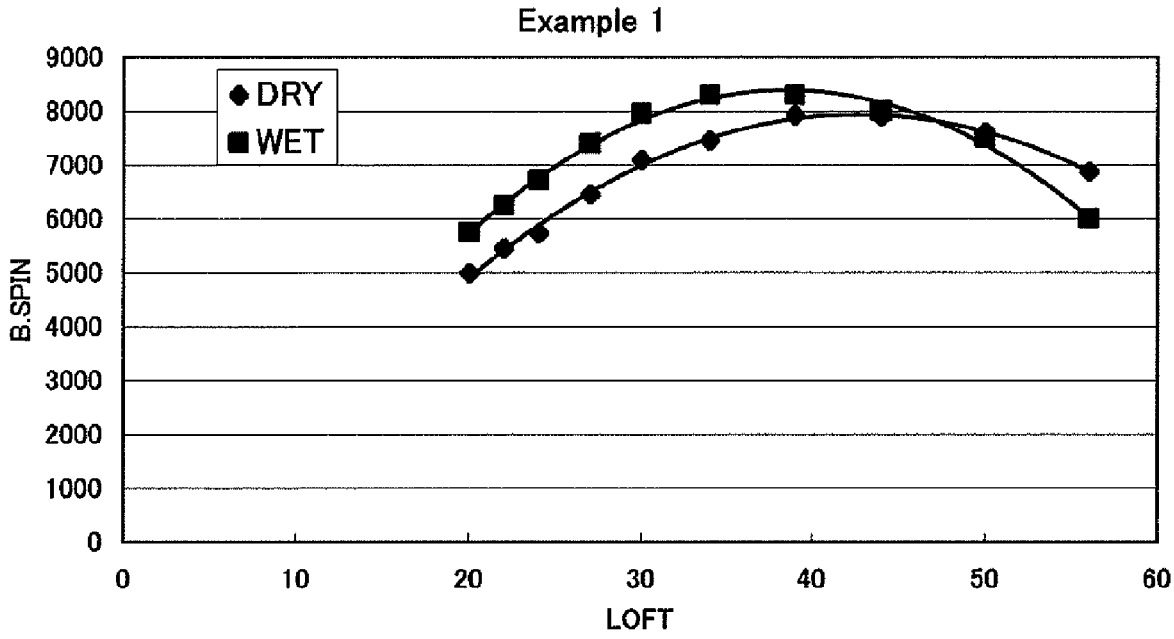
FIG. 9 is a graph showing measurement results of backspin rates of example 1.
Figure 10:
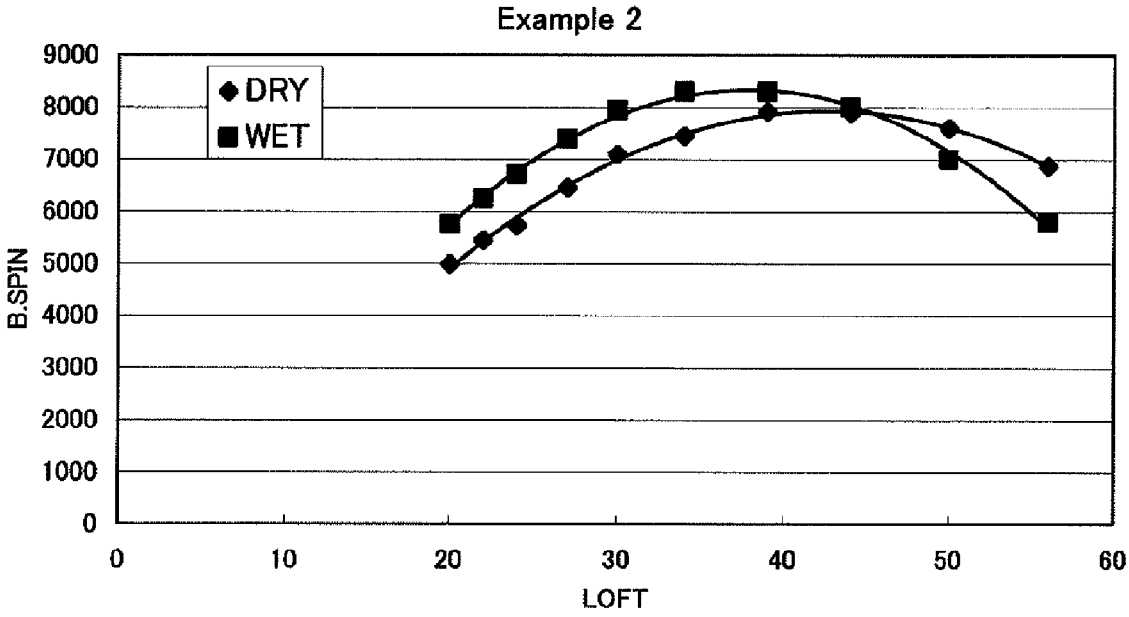
FIG. 10 is a graph showing measurement results of backspin rates of example 2.

FIG. 8 is a graph of comparative example 1. FIG. 9 is a graph of example 1. FIG. 10 is a graph of example 2.

As shown in these graphs, in the comparative examples, variation in a D−W difference is large. In particular, in the comparative examples, a club having the great real loft angle L1 has a great D−W difference. In the comparative examples, a difference between a D−W difference of a club having the small real loft angle L1 and a D−W difference in a club having the great real loft angle L1 is great. In the examples, variation in a D−W difference in the set is suppressed. Thus, the examples are highly evaluated as compared with the comparative examples. From the results, the advantages of the present invention are apparent.

The present invention can be applied to all the golf club sets.

The description hereinabove is merely for an illustrative example, and various modifications can be made in the scope not to depart from the principles of the present invention.

What is claimed is:

1. A golf club set comprising n pieces of golf clubs (n is an integer of equal to or greater than 3), wherein when groove depths D1 of face lines of the clubs are defined as D1(1), D1(2), . . . , D1(*n*) in an order from the club having the smallest real loft angle L1; and groove widths W1 of the face lines of the clubs measured by the 30 degree method of measurement are defined as W1(1), W1(2), . . . , W1(*n*) in an order from the club having the smallest real loft angle L1, D1(1)≦D1(2)≦ . . . ≦D1(*n*) and D1(1)<D1(*n*) are satisfied; the groove depths D1 of all the clubs are 0.0 (mm) or greater and 0.508 (mm) or less; a ratio [D1(*m*)/D1(*m*−1)] of the groove depths D1 between two golf clubs with adjacent club numbers in all the clubs is 1.0 or greater and 3.0 or less;

W1(1)≦W1(2)≦ . . . ≦W1(*n*) and W1(1)<W1(*n*) are satisfied; the groove widths W1 of all the clubs are 0.0 (mm) or greater and 0.889 (mm) or less; and a ratio [W1(*m*)/W1(*m*−1)] of the groove widths W1 between two golf clubs with adjacent club numbers in all the clubs is 1.0 or greater and 3.0 or less, and a roundness of curvature radius R1 is applied to the edges of face lines in the clubs, the curvature radius R1 being equal to or greater than 0.10 mm and equal to or less than 0.50 mm, wherein the golf club set comprises a golf club having a real loft angle L1 of equal to or less than 40 degrees and a golf club having a real loft angle L1 exceeding 40 degrees and a golf club having a real loft angle L1 of equal to or greater than 50 degrees;

wherein when a groove depth D1 of a club having the greatest real loft angle L1, among clubs having a real loft angle L1 of equal to or less than 40 degrees is defined as D1(X), and a groove depth D1 of a club having the smallest real loft angle L1, among clubs having a real loft angle L1 of equal to or greater than 50 degrees is defined as D1(Y), D1(X)<D1(Y) is satisfied, wherein the groove depths D1 in club numbers having a real loft angle L1 of equal to or greater than 20 degrees and equal to or less than 39 degrees are constant and groove depths D1 in club numbers having a real loft angle L1 of equal to or greater than 44 degrees and equal to or less than 56 degrees are constant.

2. The golf club set according to claim 1, wherein when groove bottom widths W2 are defined as W2(1), W2(2), . . . , W2(*n*) in an order from the club having the smallest real loft angle L1, W2(1)≦W2(2)≦ . . . ≦W2(*n*) and W2(1)<W2(*n*) are satisfied;

the groove bottom widths W2 of all the clubs are 0.0 (mm) or greater and 1.0 (mm) or less; and a ratio [W2(*m*)/W2(*m*−1)] of the groove bottom widths W2 between two golf clubs with adjacent club numbers in all the clubs is 1.0 or greater and 3.0 or less.

3. The golf club set according to claim 1, wherein a ratio [D1(*n*)/D1(1)] is equal to or greater than 1.2, and a ratio [W1(*n*)/W1(1)] is equal to or greater than 1.1.

4. The golf club set according to claim 1, wherein curvature radius R1 of edges of the face lines are constant in all the clubs.

5. The golf club set according to claim 1, wherein when curvature radius R1 of edges of the face lines are defined as R1(1), R1(2), . . . , R1(*n*) in an order from the club having the smallest real loft angle L1, R1(1)≧R1(2)≧ . . . ≧R1(*n*) and R1(1)>R1(*n*) are satisfied.

6. The golf club set according to claim 1, wherein the face lines are produced by forging, press processing, casting or cutting processing.

7. The golf club set according to claim 1, wherein the golf club set comprises a golf club having a real loft angle L1 of equal to or less than 40 degrees and a golf club having a real loft angle L1 exceeding 50 degrees.

8. The golf club set according to claim 1, wherein the number n of the clubs is equal to or greater than 6.

9. The golf club set according to claim 1, wherein all the sides of the face lines are set to curved surfaces in all club numbers.

10. A golf club set comprising n pieces of golf clubs (n is an integer of equal to or greater than 3), wherein when groove depths D1 of face lines of the clubs are defined as D1(1), D1(2), . . . , D1(*n*) in an order from the club having the smallest real loft angle L1; and groove widths W1 of the face lines of the clubs measured by the 30 degree method of measurement are defined as W1(1), W1(2), . . . , W1(*n*) in an order from the club having the smallest real loft angle L1, D1(1)≦D1(2)≦ . . . ≦D1(*n*) and D1(1)<D1(*n*) are satisfied; the groove depths D1 of all the clubs are 0.0 (mm) or greater and 0.508 (mm) or less; a ratio [D1(*m*)/D1(*m*−1)] of the groove depths D1 between two golf clubs with adjacent club numbers in all the clubs is 1.0 or greater and 3.0 or less;

W1(1)≦W1(2)≦ . . . ≦W(n) and W1(1)<W1(*n*) are satisfied; the groove widths W1 of all the clubs are 0.0 (mm) or greater and 0.889 (mm) or less; and a ratio [W1(*m*)/W1(*m*−1)] of the groove widths W1 between two golf clubs with adjacent club numbers in all the clubs is 1.0 or greater and 3.0 or less, and a roundness of curvature radius R1 is applied to the edges of face lines in the clubs, the curvature radius R1 being equal to or greater than 0.10 mm and equal to or less than 0.50 mm, wherein the golf club set comprises a golf club having a real loft angle L1 of equal to or less than 40 degrees and a golf club having a real loft angle L1 exceeding 40 degrees and a golf club having a real loft angle L1 of equal to or greater than 50 degrees;

wherein when a groove width W1 of a club having the greatest real loft angle L1, among clubs having a real loft angle L1 of equal to or less than 40 degrees is defined as W1(X), and a groove width W1 of a club having the smallest real loft angle L1, among clubs having a real loft angle L1 of equal to or greater than 50 degrees is defined as W1(Y), W1(X)<W1(Y) is satisfied, wherein the groove depths D1 in club numbers having a real loft angle L1 of equal to or greater than 20 degrees and equal to or less than 39 degrees are constant and groove depths D1 in club numbers having a real loft angle L1 of equal to or greater than 44 degrees and equal to or less than 56 degrees are constant.

11. The golf club set according to claim 10, wherein all the sides of the face lines are set to curved surfaces in all club numbers.

* * * * *